US006792722B2

(12) United States Patent
Beser et al.

(10) Patent No.: US 6,792,722 B2
(45) Date of Patent: Sep. 21, 2004

(54) CASING FOR COLD BRIDGE-FREE AIR HANDLING UNIT

(76) Inventors: Erkut Beser, 168 Sokak No:14/3, 35360 Basinsitesi-Izmir (TR); Hamdi Uysal, 2923 Sokak Palmiya Sifesi A Blok No:1 Daire:5, 35380 Bozyaka-Izmir (TR); Yildirim Arkun, 259 Sok No:12 Daire:9, 35360 Hatav-Izmir (TR)

( * ) Notice: Subject to any disclaimer, the term of this patent is extended or adjusted under 35 U.S.C. 154(b) by 22 days.

(21) Appl. No.: 10/268,171

(22) Filed: Oct. 10, 2002

(65) Prior Publication Data

US 2004/0068939 A1 Apr. 15, 2004

(51) Int. Cl.[7] ..... E04H 9/00; E04C 3/30; E04C 1/00; E04C 2/54

(52) U.S. Cl. ..... 52/79.9; 52/309.4; 52/578; 52/783.1

(58) Field of Search ..... 52/79.9, 145, 578, 52/585.1, 586.1, 309.4, 582.1, 783.1

(56) References Cited

U.S. PATENT DOCUMENTS

| | | | | | |
|---|---|---|---|---|---|
| 2,127,111 | A | * | 8/1938 | Gaenzle | 52/404.4 |
| 2,206,755 | A | | 7/1940 | Schweller | |
| 2,751,635 | A | * | 6/1956 | Donnahue | 52/69 |
| 2,927,665 | A | * | 3/1960 | Hauf | 52/262 |
| 3,310,917 | A | * | 3/1967 | Simon | 52/91.1 |
| 3,760,548 | A | * | 9/1973 | Sauer et al. | 52/592.1 |
| 3,854,261 | A | | 12/1974 | Frei | |
| 3,946,528 | A | * | 3/1976 | Jacobson et al. | 52/79.9 |
| 4,258,511 | A | * | 3/1981 | Strain | 52/79.1 |
| 5,048,248 | A | | 9/1991 | Ting | |
| 5,768,829 | A | * | 6/1998 | Thompson et al. | 52/86 |
| 6,003,271 | A | * | 12/1999 | Boyer et al. | 52/79.5 |
| 6,438,902 | B1 | * | 8/2002 | Muller | 52/79.1 |
| 6,493,996 | B1 | * | 12/2002 | Alexander et al. | 52/79.9 |
| 6,568,133 | B1 | * | 5/2003 | Rodgers | 52/79.1 |
| 2002/0005020 | A1 | * | 1/2002 | Boyer et al. | 52/79.5 |
| 2003/0024173 | A1 | * | 2/2003 | Cohen | 52/79.1 |

FOREIGN PATENT DOCUMENTS

| | | | |
|---|---|---|---|
| DE | 532973 | 9/1931 | F25D/23/06 |
| DE | 212271 | 11/1940 | F25D/23/06 |
| DE | 29708940 U | 7/1997 | F25D/13/00 |
| EP | 0034888 | 9/1981 | F16B/5/06 |
| EP | 0427626 | 5/1991 | F24F/13/20 |
| EP | 0757136 | 2/1997 | E04B/1/80 |
| WO | WO88/01327 | 2/1988 | E04C/2/26 |
| WO | WO98/28581 | 7/1998 | F25D/23/06 |
| WO | WO99/13273 | 3/1999 | F24F/13/20 |

* cited by examiner

*Primary Examiner*—Carl D. Friedman
*Assistant Examiner*—Kevin McDermott
(74) *Attorney, Agent, or Firm*—Duke W. Yee; Cathrine K. Kinslow

(57) ABSTRACT

This invention relates to an Air handling unit casing in which the circulated air is thermally conditioned and prevents the change of the thermal condition of the circulated air due to air leakage and thermal bridge. It has a modular structure which can be disassembled in the case of the necessity and is constructed from panels (1) which are made of an inner skin (15), an outer skin (16) and insulation material (9) therebetween, doors (2) and door frames (3). The embodiment of the panels (1) does not allow the direct contact of the inner and outer skin and reduces the thermal bridge and air leakage through the unit by employing gaskets (8, 11, 17), plastic bushing (18) and heat barrier slits (28). The panels (1) can be joined to each other side by side or perpendicularly.

5 Claims, 5 Drawing Sheets

CASING FOR COLD BRIDGE-FREE AIR HANDLING UNIT

BACKGROUND OF THE INVENTION

1. Technical Field

The present invention relates to a particular feature of an Air Handling Unit Casing which holds various components for changing the thermal conditions of air. More particularly the present invention relates to the feature which is "the cold-bridge-free" and "air tight" construction of the casing by means of which the heat transfer between the air inside and outside of the air handling unit and the air leakage to and from the outside air are minimized.

2. Description of Related Art

Air handling units are widely used in both comfort and industrial process air conditioning systems for the purposes of changing the thermal conditions of air and removing the undesired particles and odors from the air. Various components such as cooling and heating coils, filters, blowers, humidifiers etc. are installed inside the air handling unit casing in order to change the thermal conditions of air and in order to circulate the air through the air handling unit casing.

The function of the air handling unit casing is to physically separate the conditioned and circulated air inside the unit from the environment air outside and additionally to provide a protective cover for the inner components.

Design of the air handling unit casing is not a new subject. Generally, air handling unit casings can be classified into two groups which are called as frameless and pentapost casings. In a frameless air handling unit casing, the side by side connection of the panels is performed by direct connection of the panels to each others, while the panels are perpendicularly connected to each others by employing fixing angles such that fixing angles are independent from each others and they are not joined on the corner of the unit. The work of the Ernst Frei (U.S. Pat. No. 3,854,261, 1974) is a sample of a frameless air handling unit casing.

In the pentapost air handling unit a frame is firstly constructed. The side by side connection of the panels are performed by connection of the panels to the frame profiles. The perpendicular connection of the panels are also performed by profiles which are connected or welded to each others on the unit corners by employing corner pieces. In the pentapost air handling unit, most of the casing and employed elements weight are loaded to the frame profiles rather than the panels. The works of the Van Benthem et al (WO 99/13273, 1999) and the Louis Reigne (EPC 0 427 626 A1, 1990) present two examples for the pentapost air handling unit casings.

The main elements which comprise an air handling unit casing are doors, panels and the fixing accessories that join these elements. The doors provide access to the inside of the casing for maintaining and repairing the components or for making amendments or adjustments on the system in case of necessity. The door is basically made of two separate sheet metal plates called inner and outer skins and a filling material in between which is used for insulation. The door is also furnished with hinges along one side through which it is fixed to the panels of the casing and with door handles on the side across, for locking the door.

The panels are also constructed of two separate sheet plates and an insulation material in between similar to the doors. Since the air handling units come with different sizes depending on the required performance and air conditioning capacity, a different number and combination of standard panels are used to build each particular size of the casing and different techniques and methods are employed to join the panels.

Due to the air temperature difference between inside and outside of the air handling unit, a heat flow occurs through the casing which has to be controlled and reduced by means of applying an insulation material between the panel skins.

With the present technology and the construction outlines of air handling unit casings as described above, properties of the conditioned air are negatively affected due to occurrence of thermal-bridge and air leakage.

Disadvantages or negative effects introduced by the constructions which are produced by the present technology can be listed as follows:

In case there is any thermal-bridge in any part of the air handling unit casing, the heat transfer rate between inner and outer air is augmented and condensation may be formed locally on the casing surface depending on the inner and outer air temperature and humidity conditions. On the other hand in case of an air leakage through the adjoining surfaces of the panels due to the pressure difference between the inside and the outside of the casing condensation may occur alongside the edges of the panels and doors. If the condensation is formed on the inner surfaces of the air handling unit it promotes the corrosion of the material inside the casing and depending on the amount of condensation, some amount of water may be collected inside the air handler which is then carried to the other sections of the system and even to the conditioned space. Alternatively condensation formed outside the air handling unit casing causes rusting and corrosion of the outer skin and accumulation of condensed water in the machine room, where the equipment is installed, which degrades the hygiene in the environment.

Besides condensation problems, air leakage through panel and door joints creates energy loss and air thermal condition inside the unit deviates from the intended quantities.

Another disadvantage offered by the constructions of the present technology is that the comfort air which is filtered and cleaned through the filter sections is lost due to air leakage through the casing and/or similarly the unfiltered and unconditioned air from the environment enters to the unit due to slack joints on the air handling unit casing.

The effect of the thermal leakage (thermal bridge) from the panels on the formation of the surface condensation is more than the effect of the conductive of heat transfer of panel. In recent years, works have been performed to develop cold bridge free panels to eliminate the contact of the inner and outer panel sheets. Two old works in this subject belong to Brown Boveri et al (532 973, 1931) and work of the Paul Stauffer (212 271, 1940). In the both works, plastic pieces are employed to prevent the panel sheets contact. Raymond M. L. Tig (U.S. Pat. No. 5,048,248, 1991) has developed another type of panel are applied to buildings wall. The developed panels can not resist against loads, since they have to be attached to the objects such as building walls. The another panel has been developed by Goebel, R. A. (WO 88/011327, 1988). Again, plastic pieces are suggested to prevent the contact of the inner and out panel sheets. Although the side by side connection of the panels are described in that work, the detail of the perpendicular connection of the panels which are very important in order to obtain a close cover for unit elements and the details of the cold bridge free door and cold bridge free door frames of the unit casing are not handled. One of the another recent developed panel belongs to Louis Regiene (0 427 626 A1, 1990). A plastic piece is developed to fix the inner and outer sheets of the panels and prevent the their contact. The panels are developed for a pentapost air handling unit casing since it is mentioned that the side profiles are connected or welded to each others on unit corners. Additionally, the side by side panel connection and details of cold bridge free door and cold bridge free door frame which are required for air handling unit casing and the detail of the corner piece which provides the join of the side profiles to each others on the unit corner are not described.

SUMMARY OF THE INVENTION

One purpose of the invention is; to reduce the thermal-bridge between the inner and the outer skins of the panels which are used in constructing air handling unit casings and hence to prevent deviation of the thermal conditions of the conditioned air from that of the intended for comfort.

Another purpose of the invention is; to prevent formation of the condensation on the inner or the outer surfaces of the air handling unit casings which depends on the temperature and humidity conditions of inner and outer air and thus to prevent corrosion on the inner or the outer skin of the casing caused by this condensation.

Another purpose of the invention is; to prevent the energy losses caused by the air leakage through panel and door joints which are in turn caused by the pressure differences between inner and outer air.

Yet another purpose of the invention is to prevent loss of the filtered and cleaned air, which has already passed through filter section, through the leaking joints under the pressure differential as described above and to prevent suction of the unfiltered air inside the unit casing.

The casing of the air handling unit described by the invention is mainly composed of panels, doors and door frames.

Panels are made of an inner skin, an outer skin and an insulation material in between. The circumference of the outer skin is bent and a channel is formed all around the panel. The bent outer edges of the panel inner and outer skins are then furnished with plastic spacer bushings through which mounting bolts are inserted as to pass through insulation and the inner and outer skins. The joining of the panels to each other is realized by means of mounting bolts which pass through these bushings.

Panels are joined to each other by two different methods: In case two panels are joined side by side i.e. at a 180° angle, a gasket is placed between the facing edges in order to prevent the conditioned air leakage from inside the air handling casing to outside when there is a positive pressure in the unit, and from outside to inside when there is a vacuum in the unit.

After the panels are joined side by side another insulated and formed metal cover piece is fixed onto the channels to hide the bolts and nuts. This insulated metal cover compensates the thermal bridge due to reduced thickness of the panel around the circumference.

In case the panels are joined perpendicular to each other, a special metal fixing angle and a special rubber gasket with a triangular cross-section which fills the gap between the fixing angle and panel edges, is used to prevent air leakage and occurrence of the thermal bridge. In this method, similar to side by side panel joining, the connection of the panels is performed by mounting bolts which are placed inside the channel formed in the circumference of the outer skin except that two rows of bolts are used instead of one and bolts in each row lay perpendicular to the ones in the other row. Again as in line method there is an insulated metal cover for hiding the bolts and for reducing heat transfer through the channel.

Air handling unit door is also made of an inner skin, an outer skin and an insulation material in between. The door is fitted with hinges along one side for being mounted on the door frame which is already assembled on the air handling unit casing. A door handle and door lock on the reverse side helps to open and close it. Plastic spacer profiles are inserted between inner and outer skins around four sides to eliminate direct contact of these two parts and hence reduce the conductive heat transfer from inside air to outside air or vice versa. Additionally a continuous strip of gasket is fitted on the profile surfaces which meet the profile of the door frame surfaces for air tightness when the door is closed.

The door frame has the same basic construction as the panels. Channels are formed around on circumferences of the four sides of the door frame and a gasket seat is made on the inner skin surfaces where they meet the adjacent panels.

BRIEF DESCRIPTION OF THE DRAWINGS

The advantage of the structure of the present invention and its auxiliary elements will become better understood from the given detailed figures.

| REFERENCE NUMBERS OF ELEMENTS IN THE FIGURES |
|---|
| 1 Panel |
| 2 Door |
| 3 Door frame |
| 4 Hinge |
| 5 Door handle |
| 6 Hinge bolt |
| 7 Bolt and nut |
| 8 Door and frame gasket |
| 9 Insulation material |
| 10 Middle cover |
| 11 Gasket |
| 12 Fixing beam |
| 13 Side cover |
| 14 Side cover filing piece |
| 15 Panel inner skin |
| 16 Panel outer skin |
| 17 Panel gasket |
| 18 Plastic bushing |
| 19 Plastic spacer profile |
| 20 Door inner skin |
| 21 Door outer skin |
| 22 Door frame inner skin |
| 23 Door frame outer skin |
| 24 Sheet metal screw |
| 25 Plastic piece |
| 26 Corner cover |
| 27 Outer skin bend |
| 28 Heat barrier slits |
| 29 Channels |

DETAILED DESCRIPTION OF THE INVENTION

Figure 1:
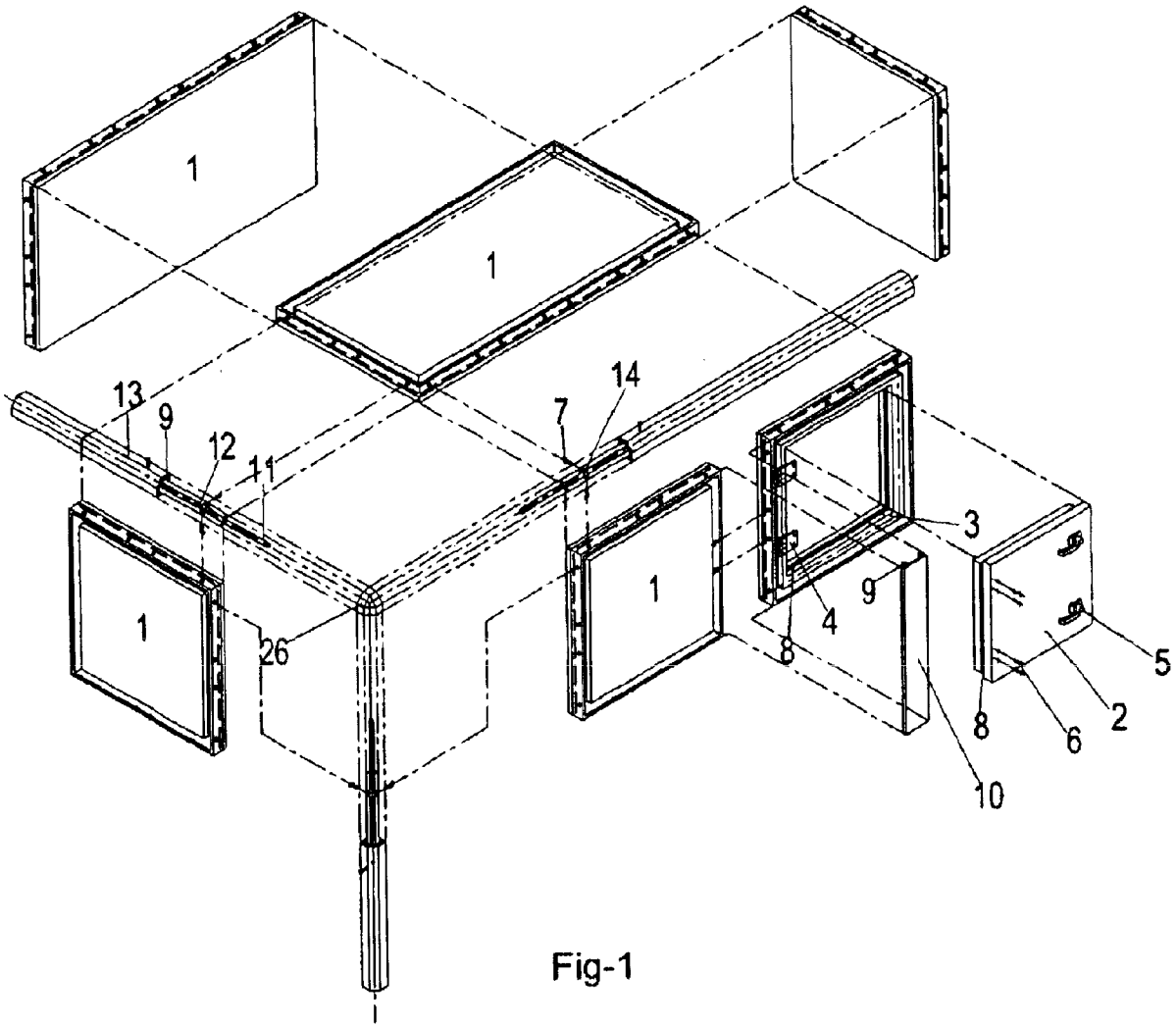
FIG. 1 shows a perspective view of the air handling unit casing

The main elements of the air handling unit casing are shown in FIG. 1. These elements are panels (1) which can be joined side by side or perpendicularly, middle cover (10) which are placed on the channels between the panels when connected side by side, side cover (13) which are located on the channels and fixing beams when the panels are joined perpendicularly, a door (2) which provides access to the air handling unit elements e.g. in order to repair them and a door frame (3) is employed to mount the door (2) to the casing.

Figure 2:
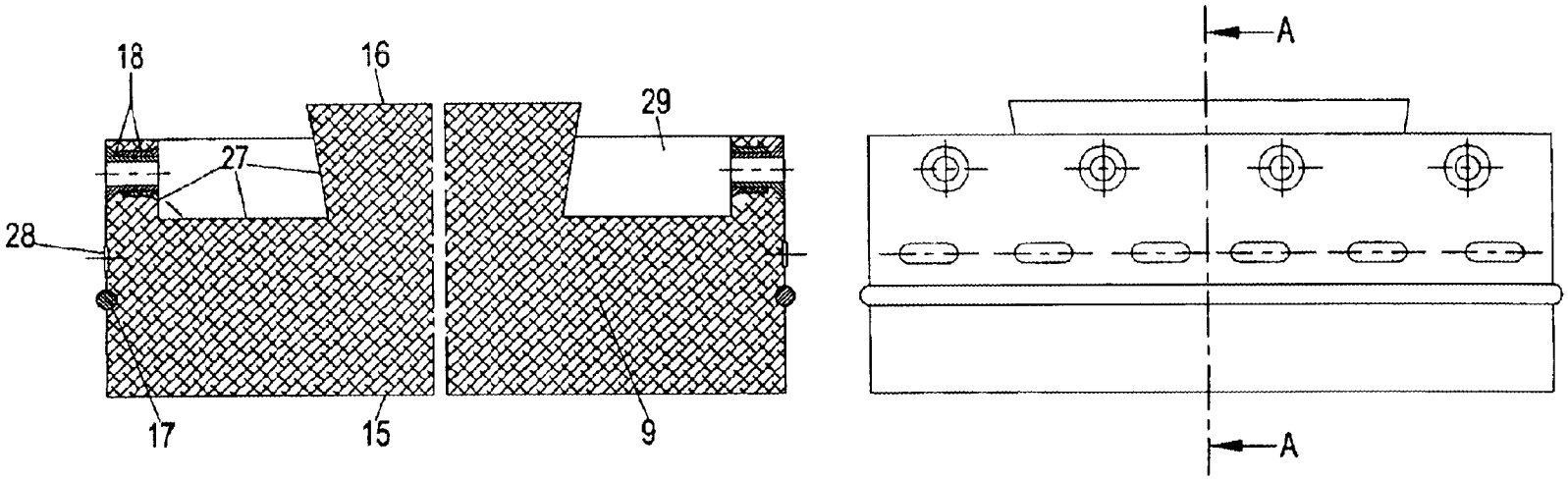
FIG. 2 shows the detail design of the panel in the scope of the invention.

FIG. 2 shows the detail of the designed panel (1) according to the present invention. The panel (1) is formed by a panel inner skin (15), panel outer skin (16) and insulation material (9) between panel skins.

The distance between panel skins (15,16) is determined such that heat transfer due to temperature difference between the inside and outside of the air handling unit is reduced to the acceptable level.

Channels (29) are formed around the circumference of outer skin (16) by bending. After joining of the panels (1) by mounting bolts (7), the channels (29) are closed by the middle and side covers (10,13). Thus, the formation of thermal bridge at the connection region is reduced to the minimum level.

Due to mounting bolt channel (29) which decrease the distance between the inner and outer skin, heat barrier slits (28) are cut around the circumference of the inner skin (15) to prevent thermal bridge formation. Thus, heat transfer through the cross section of the inner skin (15) and consequently heat transfer from the inner skin (15) to the outer skin (16) is reduced. Although there are some works on application of the heat barrier slits on decreasing of the heat transfer from the sheets (EP 0 757 136 A1, WO 98/28581), the application of this concept on air handling unit panels is introduced in this work for the first time.

Gaskets (17) are located parallel to the heat barrier slits (28) on the edges of the panels (1) in order to prevent air leakage between the inside and outside of the air handling unit in the case of the positive or negative interior working pressure.

Figure 3:
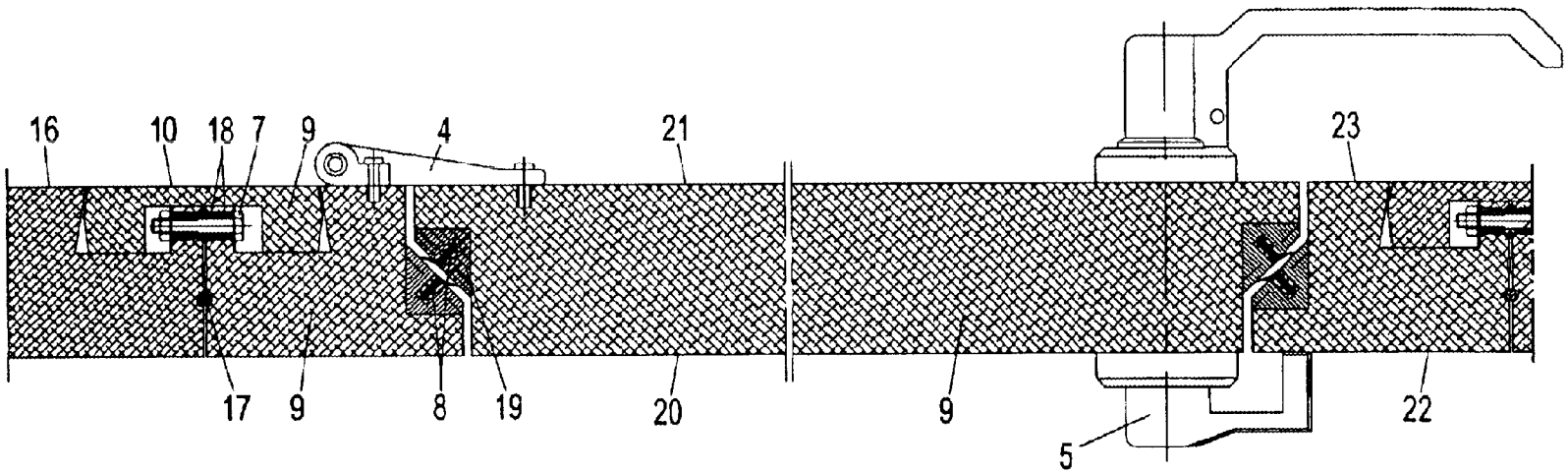
FIG. 3 shows the detail of the air handling unit door, door frame and panel connection in the scope of the invention.

The detailed view of the air handling unit door is shown in FIG. 3. The structure of the door (2) is similar to the panel (1). The door (1) is also formed by an inner skin (20), an outer skin (21) and an insulation (9) in between.

The door handle (5) is assembled on the door to open or close it. Hinges (4) are employed to connect the door (2) to the door frame (3). The inner and outer skins of the door (20,21) are inserted to the plastic spacer profile (19) in order to fix them so as to prevent them from touching each other.

A groove (8) is provided on the plastic spacer profile (19) of the door (2) for holding the gasket in position to prevent air leakage between the air handling unit and surroundings.

Figure 4:
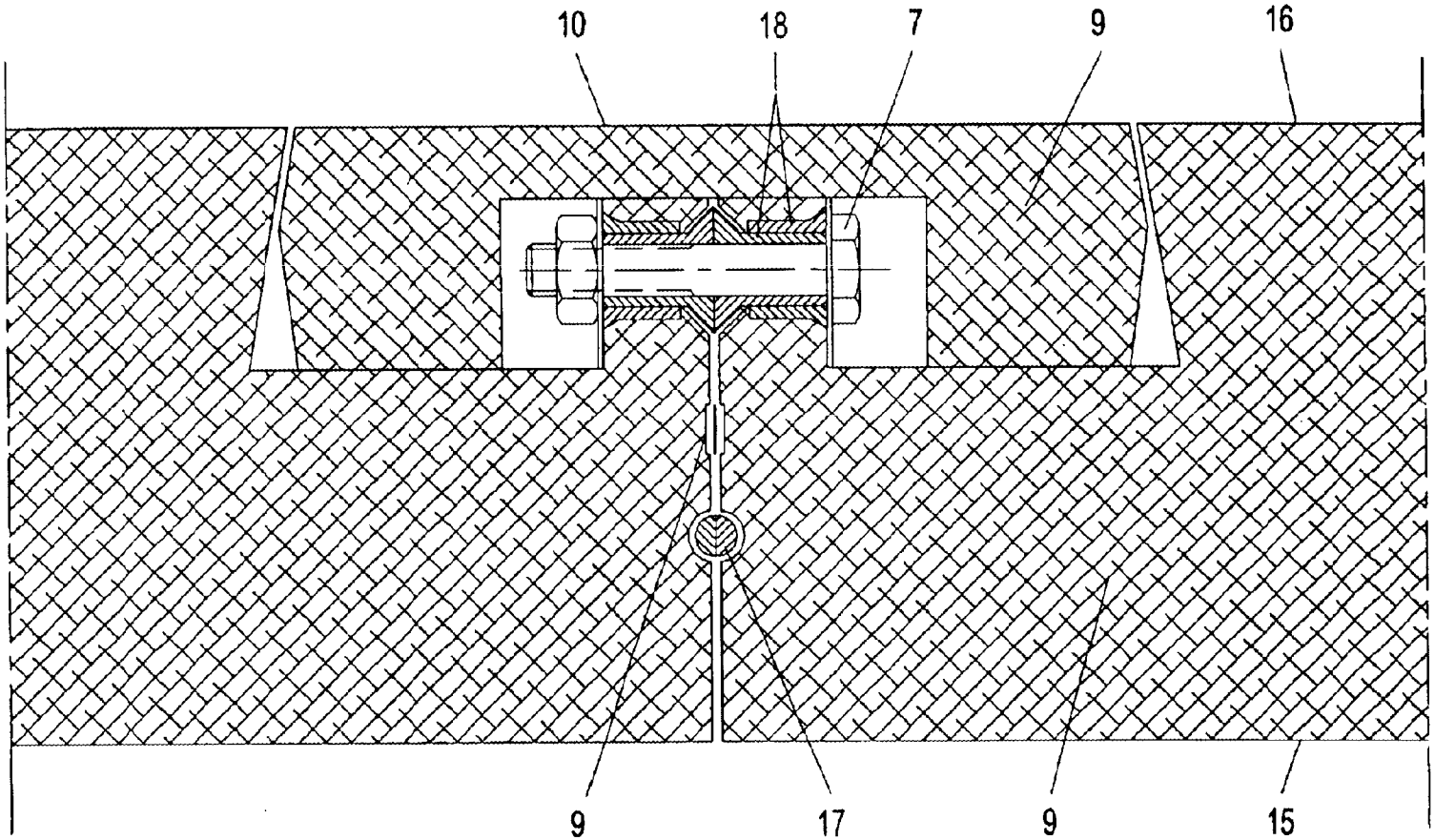
FIG. 4 shows the detail of side by side connection of two panels.

FIG. 4 shows the detail of side by side connection of two panels (1). The joining of the panels (1) to each other is performed by mounting bolts (7) located in the panel channel (29) which are formed by bending (27) of the outer skin (16).

The formation of thermal bridge between the inner and outer skins (15,16) which may occur by mounting bolts (7) is prevented by using plastic bushings (18). Two arrangements are employed to prevent formation of thermal bridge due to reduced panel thickness in the channels (29):

Firstly, the upper side of channel (29) is covered by middle or side covers (10,13) which are coated with an insulation material (9) on the inner surfaces. It not only prevents the formation of the thermal bridge but also hides the unpleasant appearance created by channels (9) and bolts (7) and forms a smooth outer casing surface.

Secondly, heat barrier slits (28) cut along the edges of the panel inner skin reduces the area which causes conductive heat transfer and consequently thermal bridge formation. In order to prevent air leakage from the inside of the air handling unit to the surroundings and vice versa, gaskets (17) are placed below the heat barrier slits (28). The air leakage through the connection surfaces between panels (1) which are located side by side is considerably reduced by employing the gaskets (17) which are pressed on each other.

Figure 5:
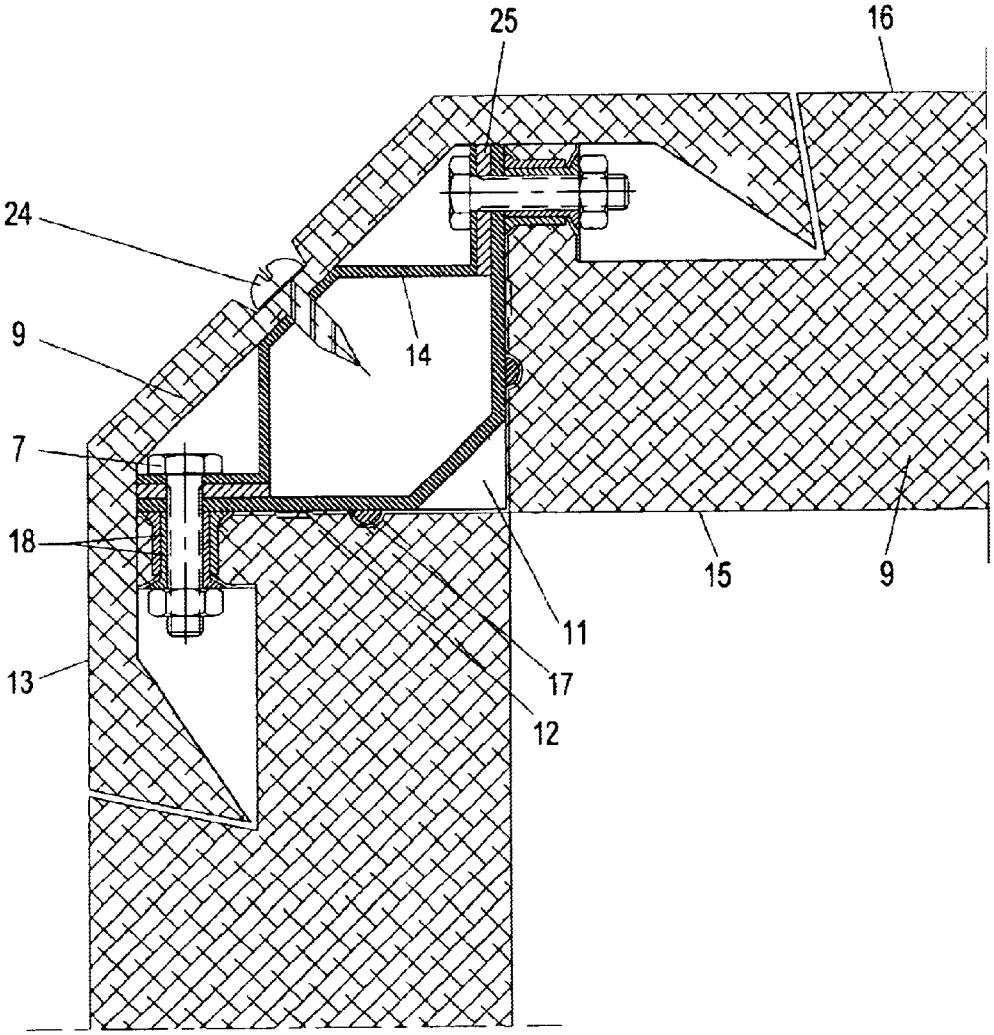
FIG. 5 shows the detail of the perpendicular connection of two panels.

The connection detail of the two panels (1) which are perpendicularly joined to each other is presented in FIG. 5. The connection of the panels (1) to each other are performed by two sets of mounting bolts (7) whose axes are perpendicular to each other.

The perpendicular connection is done by mounting bolts (7) to a fixing beam (12). The fixing beam (12) performs a task of structural integrity for the perpendicular connection of the panels (1). The air leakage is prevented by a corner gasket (11) which is located in the gap between the panels (1) and fixing beam (12).

Similar to the side by side joining of panels, a side cover (13) is employed to cover the channels around the panels and the space between the legs of the fixing beam (12) and the bolts (7). A side cover fixing piece (14) is used to fix the side cover (13). The side cover fixing piece (14) is connected to the fixing beam (12) by the sheet metal screw (24). Formation of the thermal bridge which otherwise occurs between the side cover fixing piece (14) and fixing angle (12) is prevented by a plastic piece (25) inserted therebetween.

What is claimed is:

1. A cold bridge free air handling unit casing which holds different components to change the air thermal condition mainly composed of panels (1), a door frame (3), and a door (2), the panels (1) are made of a panel inner skin (15) and a panel outer skin (16) and insulation material (9) therebetween, the door frame is made of a door frame inner skin (22) and a door frame outer skin (23) and insulation material (9) therebetween, the door which is mounted to the door frame by hinges (4) is made of a door inner skin (20) and a door outer skin (21) and insulation material (9) therebetween, plastic spacer profiles (19) are inserted between the door inner and outer skins around the four sides of the door (2) to prevent direct contact of these two parts, the casing further comprises fixing beams (12) for the perpendicular connection of panels (1), the casing is further characterized in that:

the circumference of the panel inner skin (15) is bent to form bent panel edges in which heat barrier slits (28) are cut out around the circumference of the panel inner skin to prevent thermal bridge formation and grooves are provided parallel to the heat barrier slits (28) on the panel edge for a panel gasket (17) in order to prevent air leakage between the inside and the outside of the casing, the circumference of the panel outer skin (16) is bent to form channels (29) all around the panel (1), the bent outer edges of the panel inner and panel skins are furnished with a pair of plastic bushings (18) therebetween, said bushings being distant from each other, a gasket seat for a gasket (17) is made on the door frame inner skin surface to prevent air leakage between door frame and panels when they are joined side by side, channels (29) are formed around the circumference of the four sides of the door frame outer skin, the outer edges of the door frame inner and outer skins are also furnished with plastic bushings (18), the fixing beams (12) are furnished with a corner gasket (11) which fills the gap between the panels (1) and the fixing beams (12) in order to prevent air leakage in the perpendicular panel connection.

2. The cold bridge free air handling unit casing according to claim 1 is characterized in that the side by side and direct connection of the panels (1) to each other or panels (1) to the door frame (3) without formation of a thermal bridge is provided by using bolts and nuts (7) which are inserted through the plastic bushings (18) are placed around the outer sides of the panels (1) and said door frame (3).

3. The cold bridge free air handling unit casing according to claim 1 is characterized in that the perpendicular connection of the panels (1) to each other or perpendicular connection of the panels (1) to the door frame (3) is provided by employing bolts and nuts (7) which are used to join the panel (1) to the fixing beams (12) similar to side by side panel joining except that two rows of bolts (7) are used instead of one and the two rows of bolts (7) lay perpendicular to each other.

4. The cold bridge free air handling unit casing according to claims 2 and 3 wherein the bolts and nuts (7) are disposed in the channels (29) for the panel connection and the channels are provided around the circumference of the panels (1) and are characterized by middle covers (10) and side covers (13) which are coated with insulation material (9) on the inner surfaces and are located on the panel channels (29) after side by side and perpendicular panel connection to prevent thermal leakage from the inner side of the casing to the outer side of the casing.

5. The cold bridge free air handling unit casing according to claim 1 wherein the door (2) and door frame (3) are characterized by a plastic spacer profile (19) in order to fix the door and door frame inner skins (20,22) and the door and door frame outer skins (21,23) and prevent them from touching each other and is further characterized by a gasket groove inside the plastic profile (19) to place continuous strip gaskets (17) which are fitted in the groove of the plastic profile (19) surfaces of the door (2) and door frame (3) and meet each other when the door is closed.

* * * * *